US005987269A

United States Patent [19]

Allen et al.

[11] Patent Number: 5,987,269

[45] Date of Patent: Nov. 16, 1999

[54] TONER QUANTITY MEASURING TECHNIQUE IN AN ELECTROPHOTOGRAPHIC PRINTER

[75] Inventors: Ross R. Allen, Belmont; Barclay J. Tullis, Palo Alto; Jun Gao, Cupertino, all of Calif.

[73] Assignee: Hewlett-Packard Company, Palo Alto, Calif.

[21] Appl. No.: 09/023,778

[22] Filed: Feb. 13, 1998

[51] Int. Cl.[6] ..... G03G 15/08

[52] U.S. Cl. ..... 399/27; 399/61

[58] Field of Search ..... 399/9, 24, 27, 399/30, 61, 62, 106, 49; 118/694, 688; 73/304 C; 222/DIG. 1

[56] References Cited

U.S. PATENT DOCUMENTS

| | | | |
|---|---|---|---|
| 4,977,429 | 12/1990 | Tani et al. | 399/27 |
| 4,989,754 | 2/1991 | Grasso et al. | 222/39 |
| 5,017,909 | 5/1991 | Goekler | 73/304 C |
| 5,142,909 | 9/1992 | Baughman | 73/304 C |
| 5,204,698 | 4/1993 | LeSueur et al. | 399/74 X |
| 5,247,261 | 9/1993 | Gershenfeld | 324/716 |
| 5,257,076 | 10/1993 | Nishimura et al. | 399/27 |
| 5,349,377 | 9/1994 | Gilliland et al. | 399/181 X |
| 5,460,007 | 10/1995 | Reed et al. | 62/137 |
| 5,465,619 | 11/1995 | Sotack et al. | 399/61 X |
| 5,499,077 | 3/1996 | Endo et al. | 399/27 |
| 5,512,980 | 4/1996 | Yamaguchi et al. | 399/59 |
| 5,557,368 | 9/1996 | Endo et al. | 399/27 |
| 5,636,032 | 6/1997 | Springett | 399/23 X |

*Primary Examiner*—Matthew S. Smith
*Assistant Examiner*—Hoan Tran

[57] ABSTRACT

A printer is provided with a transmit electrode and a receive electrode with a dry-toner cartridge located therebetween. The transmit and receive electrodes act as two plates of a capacitor, with the toner within the toner cartridge making up a portion of the dielectric between the two capacitor plates. An oscillating transmit signal is then applied to the transmit electrode, and a signal corresponding to the capacitance between the opposing electrodes is detected. The changing capacitance due to the changing toner quantity causes a change in the received signal. The value of the received signal is then converted into the quantity of toner residing between the opposing electrodes, and this quantity is displayed to the user. Arrangements of transmit and receive electrodes may be employed within the printer to not only sense the overall quantity of toner but the distribution of toner within the toner cartridge.

30 Claims, 7 Drawing Sheets

TONER QUANTITY MEASURING TECHNIQUE IN AN ELECTROPHOTOGRAPHIC PRINTER

FIELD OF THE INVENTION

This invention relates to electrophotographic printers, such as laser printers and copiers, and in particular to a technique for measuring the toner quantity in such a printer.

BACKGROUND OF THE INVENTION

Laser printers and copying machines typically use electrophotographic techniques to transfer dry toner particles to a rotating drum or to a sheet of paper by electrostatic attraction. After the toner is transferred to the paper, the paper is then heated to melt the toner so that the toner permanently adheres to the paper. There are many well-known types of these devices, and details of their operation need not be presented here.

Usually, the dry-particle toner is replenished by replacing a toner cartridge in the printer. The toner cartridge is typically a plastic receptacle containing the dry toner.

FIG. 1 illustrates one of many prior art toner cartridges, which is a replaceable unit in electrophotographic printers, such as laser printers and copiers. The techniques of the present invention may be used with any type of known toner cartridge. Toner cartridge 10 includes a plastic housing 12, which is normally opaque but is shown as transparent for purposes of this disclosure.

Powdered toner 14 is shown contained within housing 12. For monochrome electrophotographic printing devices, toner 14 is typically a fine, black, resinous powder. The toner is either deposited directly on charged paper or transferred from a charged surface, such as a drum, belt, or roller, to ordinary paper, then fused to the paper by heating. Toner 14 can be any known toner and need not be further described herein.

Conventional toner cartridges, such as cartridge 10, include a stirring rod 16, which may take many forms such as a rotating bar or paddle which slowly agitates the toner 14 near the bottom of a sloped trough 18 to prevent clumping of the toner and to provide even feeding of the toner into physical elements of the printing process. A typical rotation speed of stirring rod 16 is 10–30 rpm in a 24 page-per-minute printer.

Cartridge 10 includes a developer roller 20 that attracts a thin layer of toner 14 on its surface and transfers the toner particles to a photoreceptor drum (not shown) in the printer. The photoreceptor drum is selectively charged using a laser or other technique such that toner 14 only adheres to the drum in selected areas. The toner on the drum is then transferred to a sheet of paper. The paper is then heated to fuse the toner to the paper.

In other existing toner cartridges, such as cartridge 22 in FIG. 2, along with a stirring rod 24 is a primary charger roller 26 and an organic photoconductor (OPC) roller 28 proximate to the charger roller. The primary charger roller 26 charges the OPC roller 28, and a laser selectively exposes the OPC roller 28 in a pattern that produces the desired recorded image. A developer roller 20 supplies a thin layer of toner to the OPC roller 28 in the selected areas. The toner on the OPC roller 28 is then transferred to a sheet of paper to record the image onto the paper. The paper is then heated to fuse the toner completing the process. An exemplar of this toner cartridge is the C3909A LaserJet cartridge for the Hewlett Packard 5SiMX LaserJet printer.

A metal wire 32 runs proximate to the developer roller 20. A sensor (not shown) connected between wire 32 and the developer roller 20 senses the capacitance between wire 32 and the developer roller 20. When the quantity of toner is depleted to the extent that it exposes wire 32, the detected capacitance undergoes a significant change, and this is used to generate an indication to the user that the toner level is low.

Other elements may also be incorporated in toner cartridges.

It is important that an indication of toner quantity be available to a printer user either for a local or networked printer. This indication can be presented as a display on the printer or a display or message visible to the user whenever the printer is invoked by an application program. Knowledge that the remaining quantity of toner is inadequate for a printing task is of significant value to a user and to service personnel. Some solutions in the current art, in addition to that described with respect to FIG. 2, include providing a toner cartridge with a window through which the user or a photosensor may observe toner quantity, incorporating electrodes into the toner cartridge to detect a threshold quantity of toner, or other techniques which require a modification to the toner cartridge such as floats, paddles, or other physical sensors known in the art operating in contact with the toner. Modifying existing toner cartridges to include a means for sensing the toner quantity adds cost to each cartridge. In addition, all methods currently in practice do not operate over the full range of toner quantity from full to empty and offer poor accuracy.

What is needed is a more economical and accurate technique for measuring the toner quantity in a toner cartridge.

SUMMARY

The technique used by the present invention to measure toner quantity in a toner cartridge does not require modification to the toner cartridge and may be used with existing toner cartridges. A printer is provided with at least a transmit electrode and a receive electrode, with the toner cartridge located therebetween. The transmit and receive electrodes act as two plates of a capacitor, with the toner within the toner cartridge making up a portion of the dielectric between the two capacitor plates. An oscillating electric signal is then applied to the transmit electrode, and a signal affected by the capacitance is detected. The changing toner quantity thus causes a change in the received signal. The value of the received signal is representative of the quantity of toner contained between the opposing electrodes.

In one embodiment, the received signal is filtered to remove extraneous electrical noise, rectified or demodulated, filtered again, converted to digital form. In this process, the signal may be gain adjusted and a DC offset applied in order to take advantage of the dynamic range of an analog-to-digital converter. Characteristics such as minima and maxima of the signal are extracted, and the results applied to a look-up table or used in an analytical expression to convert the measurement into a representation of remaining toner quantity. The contents of the look-up table or the coefficients and form of an analytical expression are typically determined experimentally.

The output of the look-up table or analytical expression may be further processed and applied to a visual display to indicate to the user the quantity of toner remaining or provide an estimate of the number of pages which can be printed. This display may be on the printer or presented remotely to the user in the form of a pop-up window, menu item, print command dialog box, or other indication on the user's display.

Arrangements of transmit and receive electrodes may be employed within the printer to sense not only the overall quantity of toner but also the distribution of toner within the toner cartridge. The distribution of toner is useful information: if it is not uniform, toner distribution can affect print quality adversely and require replacement or manipulation of the toner cartridge before all the toner is completely consumed.

DETAILED DESCRIPTION OF THE EMBODIMENTS

Figure 3:
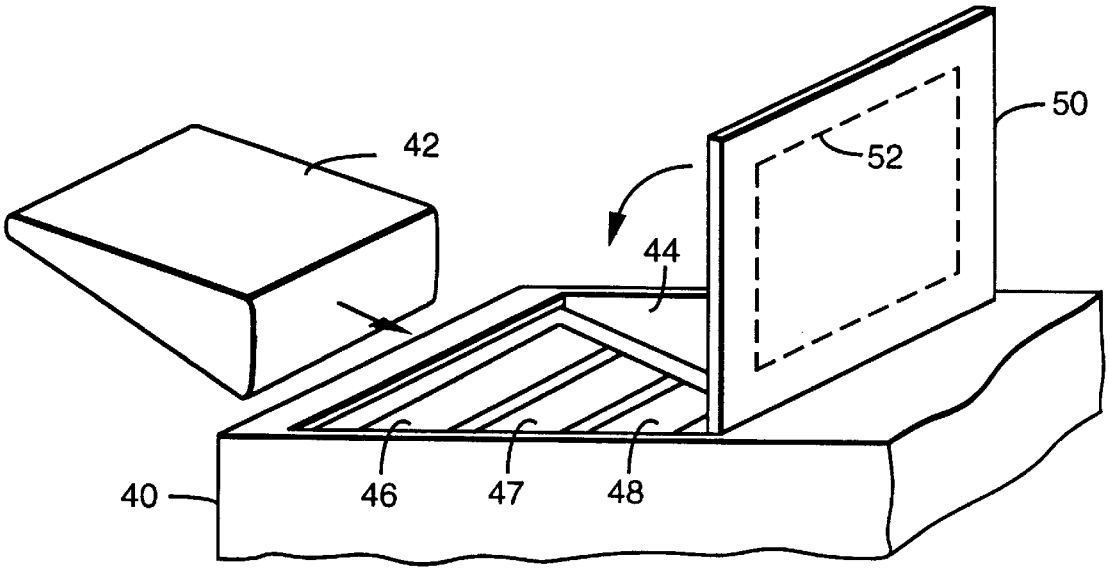
FIG. 3 illustrates transmit and receive electrodes in a printer used for measuring the quantity of toner in a toner cartridge.

FIG. 3 illustrates a printer 40 which incorporates one embodiment of the present invention. Printer 40 may constitute a laser printer, a copier, or any other printer which has a toner cartridge receptacle.

A conventional toner cartridge 42 is shown being inserted into an opening 44 in printer 40. Toner cartridge 42 may be any of the toner cartridges previously described or any other known toner cartridge. The shape of toner cartridge 42 is relevant to the present invention only in its effect on the number and placement of electrodes required for accurate measurement of remaining toner quantity.

In the preferred embodiment of the present invention, the quantity of toner within toner cartridge 42 is measured without any modification to the toner cartridge 42.

In another embodiment, conductive films or wires are incorporated into the cartridge during manufacture to provide electrodes used by the present invention. For example, this can be done inexpensively with adhesive-backed metal tapes applied to the outer surface of the cartridge. These tapes could accomplish other functions as well if they were printed with user instructions, product part number, and manufacturer's information.

Further, existing printers may be modified to employ the present invention at reasonable cost.

Printer 40 contains at least one transmit electrode and at least one receive electrode in receptacle 44 positioned such that the toner within toner cartridge 42 resides within the electric field created by the transmit and receive electrodes. The placement of the transmit and receive electrodes may be reversed. The size and placement of electrodes are optimized for a particular model of printer and toner cartridge. In the particular embodiment of FIG. 3, three receive electrodes 46, 47, and 48 are positioned on the bottom surface of receptacle 44. A hinged door 50 of printer 40 supports a transmit electrode 52, shown in dashed outline. Electrodes 46–48 and 52 may each be a thin conducting tape (such as a copper tape with an adhesive backing) which is simply adhered to the surfaces of an existing printer, such as the Hewlett-Packard 5SiMX LaserJet printer.

Although only one receive electrode is required for this invention, multiple electrodes enable one to identify the distribution of the toner within toner cartridge 42, as will be later described. The receive electrode configuration of FIG. 3 enables one to determine the distribution of toner along the length of toner cartridge 42.

Figure 4:
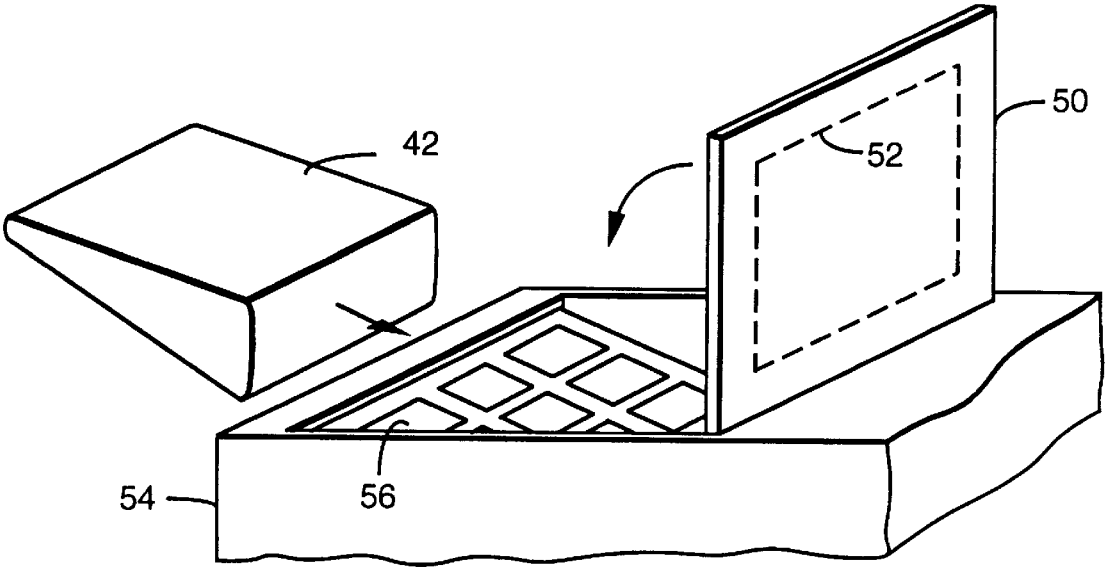
FIG. 4 illustrates an alternative arrangement of receive electrodes.

FIG. 4 illustrates another printer 54 having a two-dimensional array of receive electrodes 56, which may be used to detect the distribution of toner along the width and length of cartridge 42.

To explain the principles of this invention, it will be assumed that the receive electrode configuration of FIG. 3 is used, although the invention is equally applicable to the configuration of receive electrodes shown in FIG. 4 and to other configurations.

Figure 5:
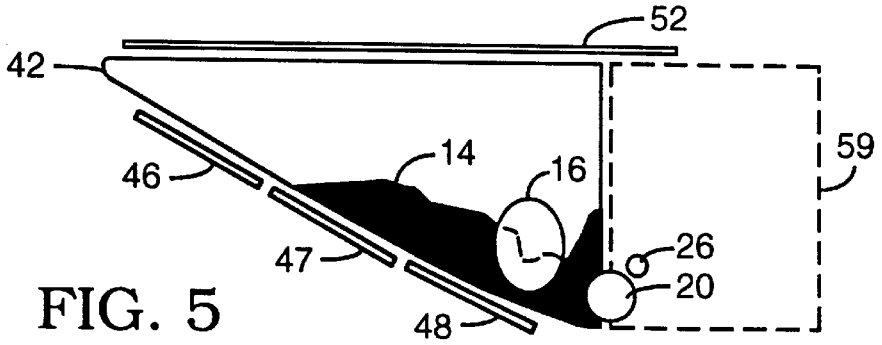
FIG. 5. illustrates a toner cartridge installed in the printer of FIG. 3.

FIG. 5 is a schematic view of toner cartridge 42 inserted into printer 54 of FIG. 4 with hinged door 50 closed. Transmit electrode 52 is shown residing above toner cartridge 42, and receive electrodes 46–48 are shown residing below toner cartridge 42. The various electrodes need not be in contact with toner cartridge 42. Conventional electrostatic toner transfer mechanisms are located in dashed outline 59 and need not be described herein.

Figure 6:
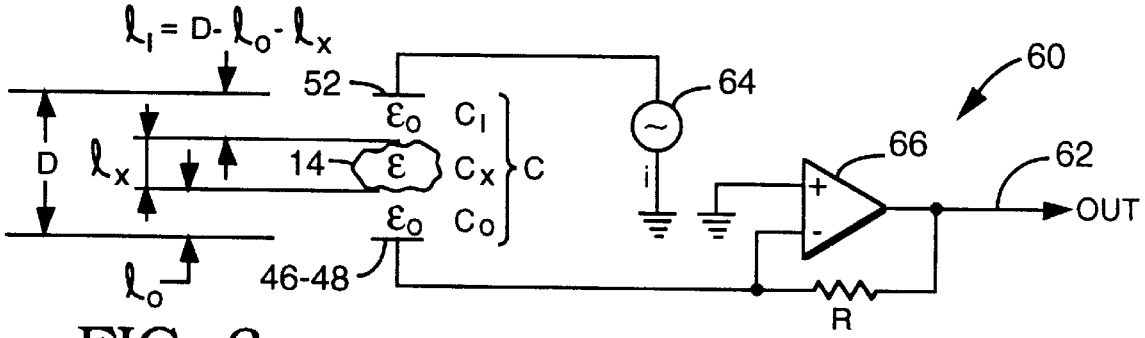
FIG. 6 is a schematic diagram of a current-to-voltage converter used to output a signal corresponding to the value of a capacitor.

FIG. 6 illustrates a signal generator and receiver circuit 60 which is connected between the transmit electrode 52 and the receive electrodes 46–48 to generate a signal at node 62 which responds to the quantity of toner 14 in cartridge 42. An oscillator 64 generates a voltage signal that is applied to the transmit electrode 52 and generates an electric field through the toner. An operational amplifier 66 functions as a current-to-voltage converter with its non-inverting terminal connected to ground and its inverting terminal connected to one or more of electrodes 46–48. The displacement current induced into or from a receive electrode 46–48 by the electric field is converted into an output voltage at node 62. A feedback resistor R determines the current-to-voltage gain of amplifier 66.

As seen from FIG. 6, the surfaces comprising transmit electrode 52, the upper and lower surfaces of the toner pile, and the receive electrodes 46–48 form three capacitors $C_1$, $C_x$, $C_0$ in series, and the capacitances $C_1$ and $C_x$ will vary depending upon the separation distances $l_1$ and $l_x$.

Capacitance is calculated using the equation:

$$C=AK\dot{a}_0/l, \qquad \text{Eq. 1}$$

where

C is the capacitance $\dot{a}_0$ is the permittivity of empty space ($8.85\times10^{-12}$) coul$^2$/newton$^2$–m$^2$)

K is the dielectric coefficient (about 3 for toner and 1 for air)

A is the plate area, and l is the dielectric thickness.

All values in equation 1 are fixed for each capacitance in series except for the dielectric thicknesses $l_1$ and $l_x$, which will change with the quantity of toner between the transmit and receive electrodes.

It may be noted that when an electrophotographic printer has not printed pages for some time, the toner can settle, increasing its density and affecting its dielectric coefficient. During printing, toner is stirred within the toner cartridge so as to assure delivery to the electrophotographic transfer process. This can cause the toner to flocculate temporarily, changing both the effective dielectric coefficient of the toner and the effective dielectric thickness. Knowledge of the printer's recent printing history can be used to estimate the effects of and compensate for toner settling and flocculation.

The dielectric displacement current measured by the current-to-voltage amplifier 66 depends on the net capacitance C in FIG. 6. Net capacitance can be $$C = \frac{C_0C_1 + C_0C_x + C_1C_x}{C_0C_1C_x}$$

Since the current is dependent upon the impedance of capacitance C, given as $j/2\pi fC$, as the dielectric thickness $l_x$ of capacitance $C_x$ is lowered, the net capacitance decreases, causing the impedance to increase, resulting in a decreased current. A decreasing quantity of toner in cartridge 42 decreases the overall capacitance between the transmit and receive electrodes thereby lowering the magnitude of the signal at node 62 in FIG. 6.

The voltage at node 62 is applied to signal processing circuitry which ultimately correlates the level of the signal to the toner quantity. This quantity may be then conveyed to a system administrator over a network, to the user using a display on the printer or accessible remotely by the user, or used by the printer controller to disable printing when the quantity of toner remaining is estimated to be insufficient to complete a print job.

Other circuits beside that described in FIG. 6 may be developed by those skilled in the art to generate a signal which detects a change in displacement current or capacitance value, and the present invention is not limited to the embodiment of FIG. 6. For example, the receive electrodes may be grounded and the current to the transmitter may be sensed instead of the current to the receive electrodes.

Full toner cartridges 42 typically contain on the order of 250–1000 grams of toner, depending on the model. The toner used in electrophotographic printers is typically composed of 50% to 95% by weight of a thermal plastic resin, such as polystyrene, polyethylene, or polyester. To this may be added magnetite, colorant, and (in quantities each typically less than 10%) various additives such as waxes and charge control agents. The toner has a dielectric coefficient near 3, which is significantly different from air ( 1.0), and the quantity of toner contained in a full cartridge 42 is significant compared to the mass of its storage container. Hence, the quantity of the dielectric toner material can be measured by observing capacitive effects in an alternating electric field between the transmit and receive electrodes.

Figure 7:
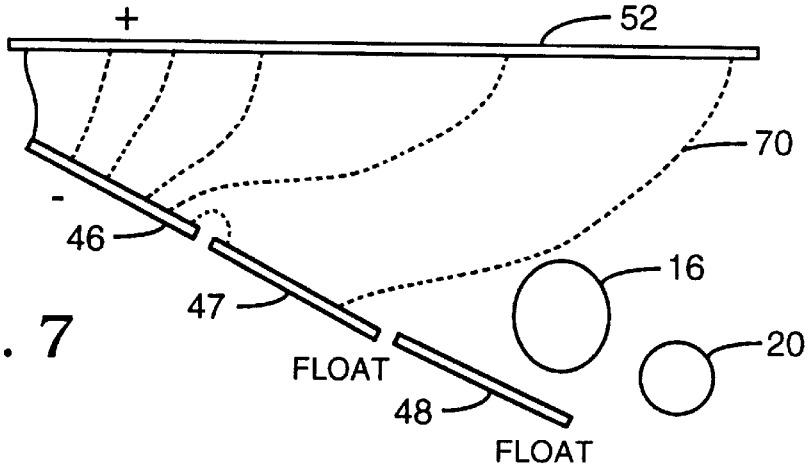
FIGS. 7 and 8 illustrate the electrical field lines for different electrical configurations of the receive electrodes.

FIG. 7 illustrates the use of a plurality of receive electrodes in detecting the distribution of toner within cartridge 42. FIG. 7 shows the electric field lines 70 between the transmit electrode 52 and the receive electrodes 46–48, with receive electrode 46 virtually grounded (by device 66 in FIG. 6) and receive electrodes 47 and 48 floating.

In this electrical configuration, the measurement will primarily identify the quantity of toner in the upper and leftmost portion of cartridge 42.

Figure 8:
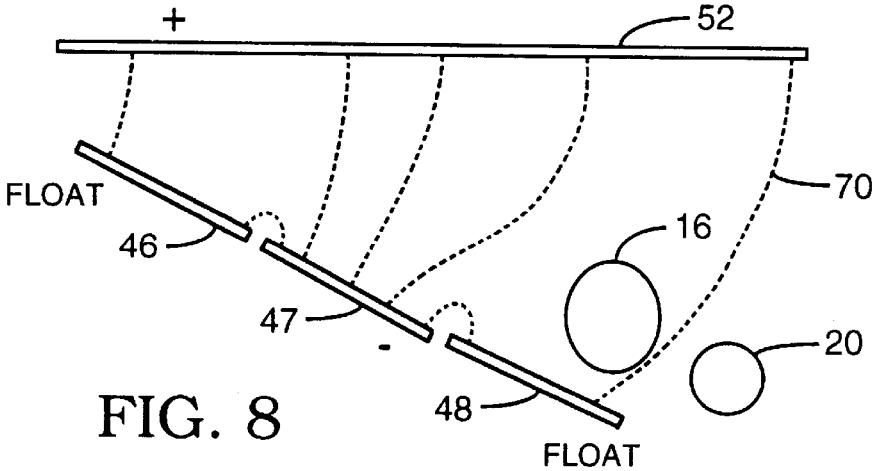

FIG. 8 illustrates another electrical configuration where receive electrodes 46 and 48 are floating, and receive electrode 47 is at a virtual ground. This configuration will primarily identify the quantity of toner in the middle portion of cartridge 42.

Other physical and electrical configurations for the transmit and receive electrodes may also be used to identify other characteristics of the distribution of toner in cartridge 42, and the present invention is not limited to the configurations disclosed herein. In one embodiment, the electrical configurations of the receive electrodes 46–48 are sequentially changed to obtain various readings to identify the distribution of toner within cartridge 42. Measuring the distribution of toner within cartridge 42 is of practical importance. For example, while the overall quantity of toner within cartridge 42 may be determined using only a single receive electrode, this quantity of toner may have accumulated in a volume within cartridge 42 where it cannot be delivered to the transfer roller. Thus, detecting the distribution of toner within cartridge 42 allows indication of a situation which may require the cartridge to be removed and manually shaken to redistribute the toner so as to allow it to flow to the bottom of cartridge 42. This information may be significantly more useful than a conventional "toner low" signal, which cannot discriminate between toner exhaustion and the presence of undeliverable toner.

The configuration of receive electrodes in FIG. 7 may be used to detect the distribution of toner along the length of cartridge 42. Alternatively, an array of receive electrodes may be segmented across the width of the cartridge instead of across its length, or a two dimensional array of receive electrodes and/or transmit electrodes, shown in FIG. 4, may be incorporated to detect the distribution of toner anywhere within cartridge 42.

Figure 9:
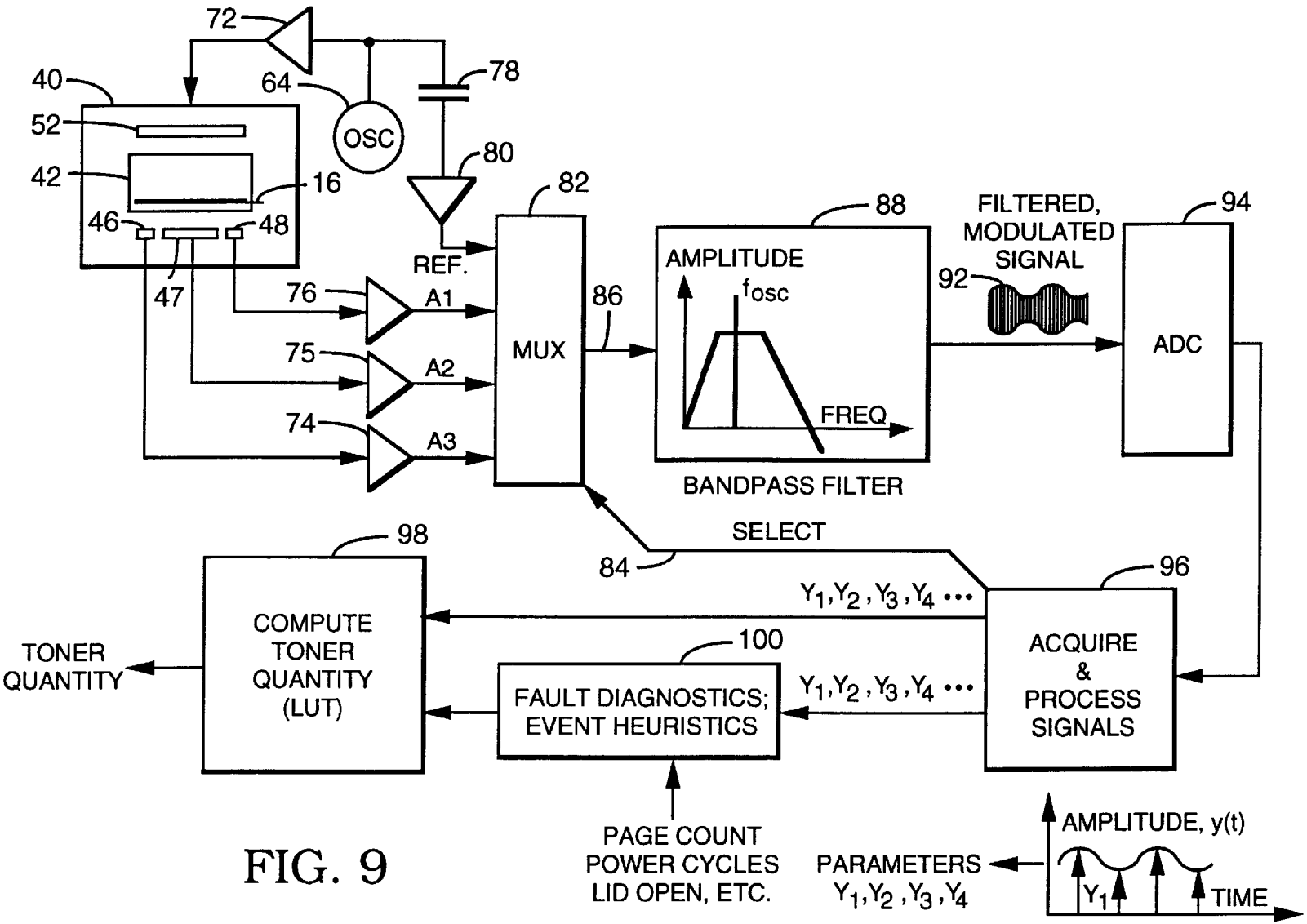
FIG. 9 is a functional block diagram of one embodiment of the invention.
Figure 10:
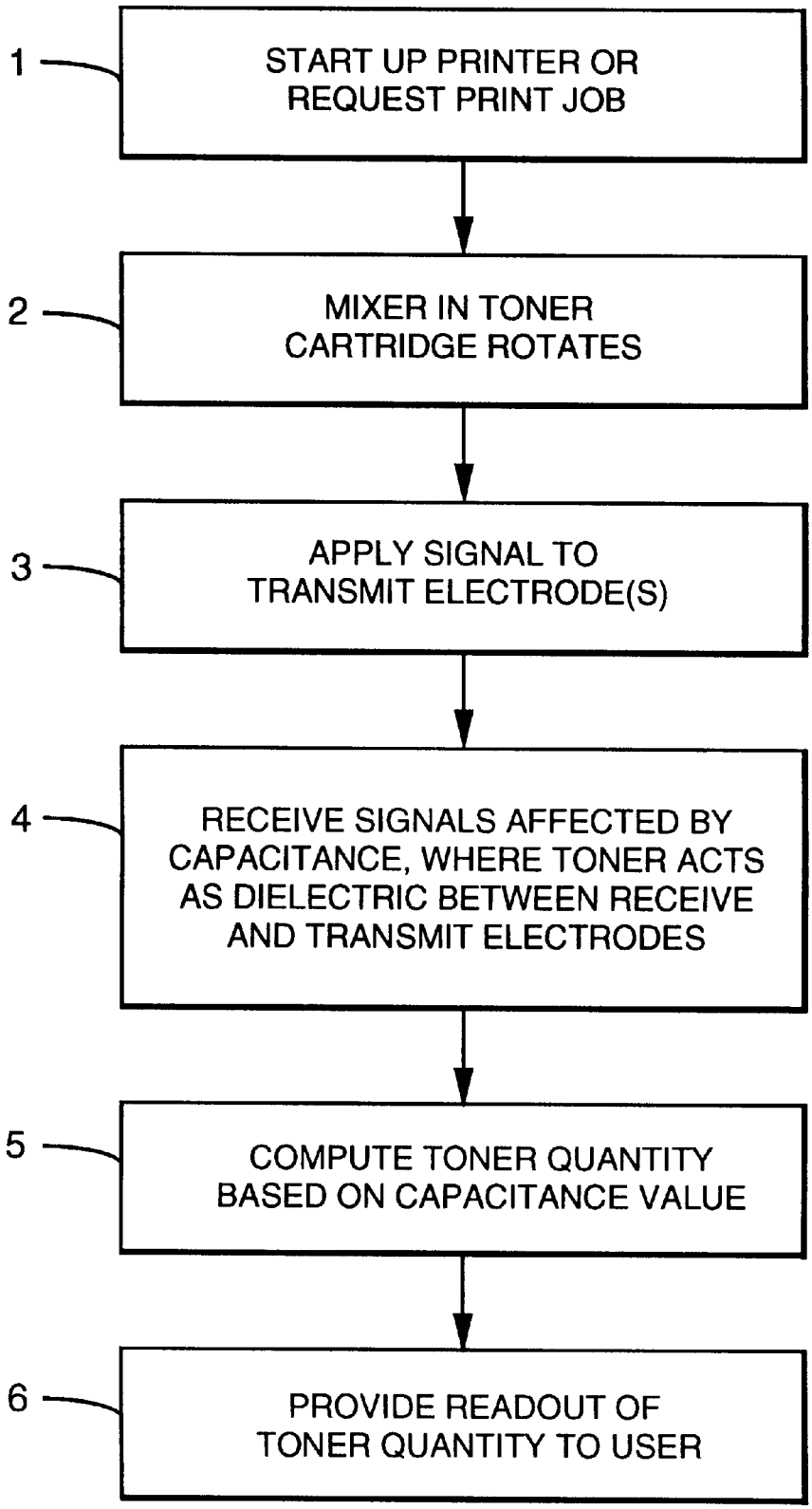
FIG. 10 is a flowchart illustrating the basic steps carried out by the device of FIG. 9.

FIG. 9 illustrates the functional units used in one embodiment to detect the overall quantity of toner in cartridge 42 and the distribution of toner in cartridge 42. FIG. 10 is a flow chart which identifies the basic steps carried out by the printer incorporating the present invention. The present invention is not limited to this sequence of processing steps, and alternative process sequences may be obvious to those skilled in the art.

As shown in FIG. 9, a toner cartridge 42 is inserted into the printer 40 and forms part of the dielectric between the transmit electrode 52 and the receive electrodes 46, 47, and 48. An oscillator 64 output is applied to the transmit electrode 52 via a buffer amplifier 72, if necessary. The signal generated by oscillator 64 is, in one embodiment, at a frequency of 18.25 KHz. The toner in cartridge 42 acts as an amplitude modulator of the 18.25 KHz carrier frequency. Other frequencies may be used with equal or superior effect.

Each of the receive electrodes 46, 47 and 48 is connected to a respective current-to-voltage converter 74, 75, and 76, which may be conventional in design.

A reference or calibration load capacitor 78 is also connected to an output of oscillator 64 and to a current-to-voltage converter 80. The resulting reference signal is used to scale the signals from the receive electrodes by monitoring the output of oscillator 64. The outputs of converters 74–76 and 80 are connected to input terminals of a multiplexer 82, which is controlled by a selector signal 84 to pass one of the four inputs to an output 86 of multiplexer 82.

Multiplexer 82 may be used to combine the outputs of converters 74–76, effectively increasing electrode size and measurement sensitivity.

The output of multiplexer 82 is applied to a bandpass filter 88, having a center frequency at the carrier frequency of oscillator 64, to filter out noise and to provide anti-aliasing for analog-to-digital signal conversion. Considering the physical arrangement of toner cartridge 42 in FIG. 9, the output of filter 88 will be the carrier frequency modulated not only by the quantity of toner in cartridge 42 but also by the rotation of any conducting stirring rods 16 (FIG. 5) as it rotates at approximately ⅙–½ revolutions per second.

Figure 11A:
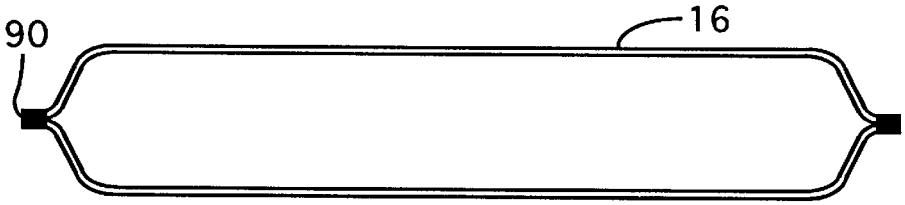
FIGS. 11A and 11B illustrate a stirring rod within the toner cartridge.
Figure 11B:
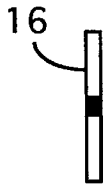

In a typical toner cartridge 42, stirring rod 16 is simply a metal wire similar to that shown in FIG. 11A, where an end 90 is turned by a motor internal or external to cartridge 42. FIG. 11B shows a side view of the stirring rod 16.

Figure 12:
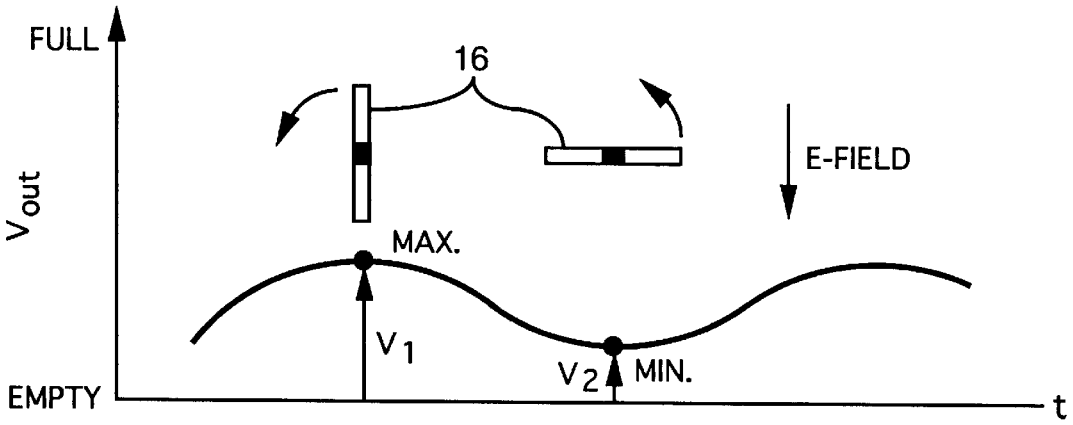
FIG. 12 illustrates the modulation of the received signal due to the rotation of the stirring rod.

FIG. 12 illustrates the modulation effect on the amplitude of the detected carrier signal as the stirring rod 16 rotates. Why a conductive stirring rod modulates the detected signal can be understood in the simplified discussion that follows. Assuming that the stirring rod is a rectangular conducting loop of wire, when the plane of the metal stirring rod 16 is aligned with (i.e., parallel to) local electric field lines between the transmit and receive electrodes, the capacitance is a maximum, resulting in a maximum signal output of filter 88. This is because the metal stirring rod 16 is conductive and at the same electrical potential. So, when the plane of the rod is parallel to the local field it effectively shorts out the field along the height of the rod thereby increasing the signal. Conversely, when the plane of the stirring rod 16 cuts across (i.e., is perpendicular to) the field lines between the transmit and receive electrodes, the effect on the signal is minimized.

In one embodiment, the position of the stirring rod modulates the carrier such that after demodulation, the voltage difference between the maximum and minimum points in the graph of FIG. 12 is on the order of one volt when a cassette is full with the maximum signal near 5 volts, and with the minimum signal near zero volts when empty.

When a toner cartridge 42 contains conductive components, such as a stirring rod 16, whose position modulates the received signal, it is necessary to take a toner level measurement when these components are in motion so as to detect the effects of their modulation. Otherwise, the arbitrary position of such components when not in motion will have an unknown effect on received signal amplitude. Therefore, the detection of signals at the receive electrodes 46–48 should occur after printer 40 initiates the rotation of paper feed motors, but before activation of high voltages used in the electrophotographic recording process that may generate electromagnetic interference, introducing noise into the transmit or receive electrode signals. The time between the initiation of a printing operation and the electrical activation of components which generate electromagnetic interference to the toner level measurement is typically on the order of 3 seconds. During this time, the stirring rod 16 and other mechanical components of cartridge 42 rotate. This is reflected in steps 1, 2, and 3 of FIG. 10. Hence, the readings of the signals from the receive electrodes 46–48 should be taken within this electrically quiet period. The signal received during this period is represented in FIG. 9 by the modulated signal 92 (step 4 in FIG. 10). In practice, samples from each of the 4 inputs into multiplexer 82 will be measured during this period.

In order to facilitate toner quantity measurements by the method of this invention, it is desirable not only to disable the voltages normally applied to cartridge 42 as part of the electrophotographic printing process, but also to allow components within the cartridge 42 normally connected to external sources and receivers to electrically float with respect to ground. This not only eliminates sources of electrical noise but also the effects of electrically-grounded conductors within the oscillating electric field used by the present method for toner quantity sensing. Experiments show a significant improvement of linearity and increase in detected displacement currents when conductive components within cartridge 42 are electrically isolated and allowed to float with respect to ground.

The filtered signal is next applied to an analog-to-digital converter (ADC) 94 of conventional design.

This digital signal is next applied to a process 96 (which may include a microprocessor) which performs various signal processing functions. Process 96 demodulates the digital signal to remove the carrier frequency, filters the 3 sets of signals and the reference signal to remove or suppress interference and noise, and makes gain and DC offset adjustments. The demodulation process may use quadrature detection, synchronous detection, or other techniques known in the art. Process 96 may be accomplished by analog, digital, or a combination of analog and digital operations known in the art.

Process 96 typically produces the minimum and maximum values of the modulated signal for each of the four signals over the approximately three second interval during which the readings have occurred.

Process 96 also controls multiplexer 82 so that each of the four inputs are sampled at a Nyquist rate or greater.

A look-up table (LUT) 98 relates toner quantity to the signals output by process 96. The contents of LUT 98 are based upon empirical data and correlate the quantity of toner to the demodulated and processed signals. For example, this signal may be represented by values $V_1$ and $V_2$ in FIG. 12, the maximum and minimum values of the processed signal reflecting the effects of stirring rod position. This is shown by step 5 in FIG. 10. Values stored in the LUT 98 represent the value of toner quantity as a function of $V_1$, $V_2$, or a combination of $V_1$, and $V_2$. For values of $V_1$, $V_2$, or an independent variable that do not correspond exactly to discrete values for which toner quantity is tabulated, and interpolation operation is employed in a manner well known in the art.

In another embodiment, a polynomial or other approximation to the relationship between processed signal and toner quantity may be used. Experimental data for the Hewlett-Packard LaserJet 5Si cartridge show that a third-order polynomial provides a useful analytical approximation using $V_2$ as input variable.

Figure 1:
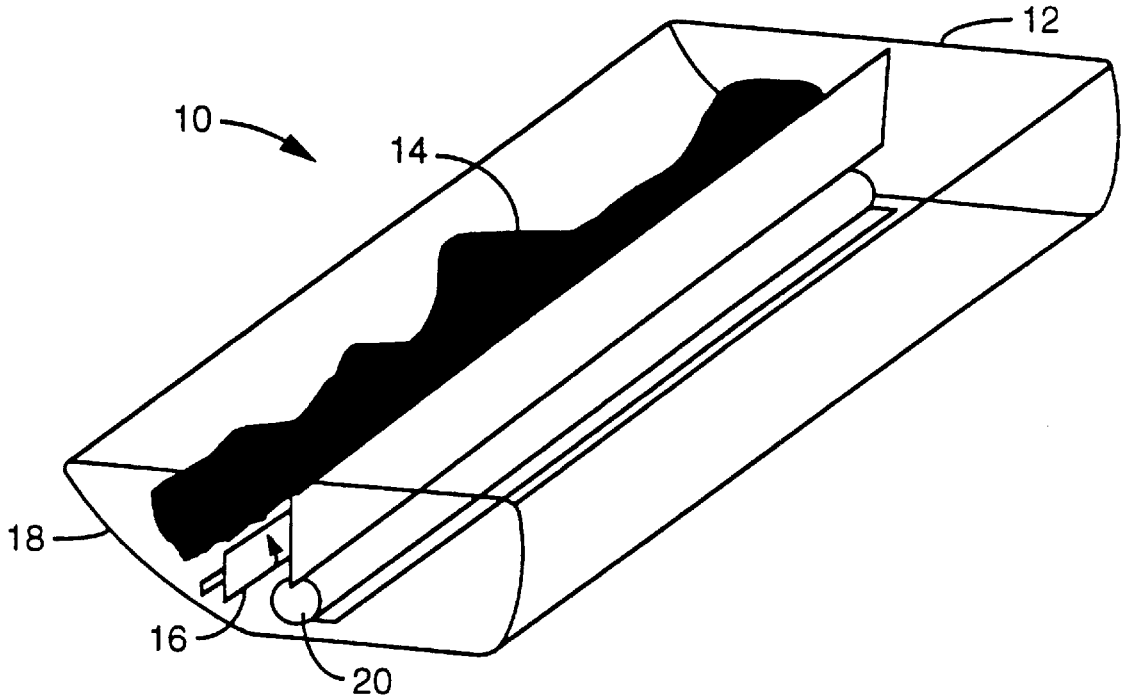
FIG. 1 (PRIOR ART)
FIG. 1 is a perspective view of a prior art toner cartridge for a printer.
Figure 2:
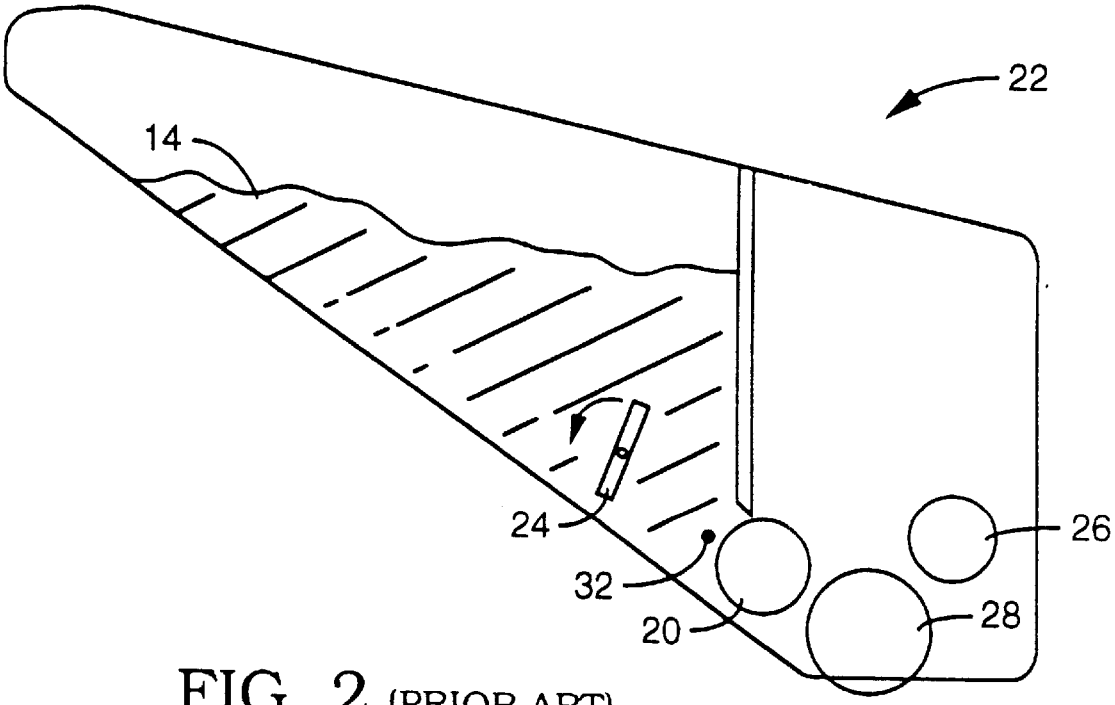
FIG. 2 (PRIOR ART)
FIG. 2 is a side view of another prior art toner cartridge.

In one embodiment, process 96 weights each of the signals from receive electrodes 46, 47, and 48 to normalize the signals from the three electrodes. The minimum and maximum values from each of the three receive electrodes are then applied to LUT 98 as an index to compute the total quantity of toner in cartridge 42, ranging between empty and full. For each receiver signal, the minimum values best represent toner quantity, but the values of the minima and maxima may be used to determine the toner's dielectric coefficient and to compensate during measurements for the effects of toner compaction and flocculation on the dielectric coefficient As previously stated, the toner may be undesirably distributed in cartridge 42 such that the toner at the bottom of trough 18 (FIG. 1) in cartridge 42 is very low, yet the overall toner quantity signal indicates the cartridge 42 is not close to empty. To detect such a situation, the plurality of receive electrodes 46–48 are used to identify the distribution of the toner. A processing block 100 for detecting possible faults and other information (event heuristics) for diagnostic purposes receives signals from process 96 corresponding to the signals from each of the receive electrodes 46, 47 and 48 and receives other information such as page count, power cycles, toner compartment lid open sensor signals, and other signals. Processing block 100 may thus give an indication whether the toner is undesirably distributed in a certain area of cartridge 42, whether the processed toner quantity measurement is inconsistent with the printed page count after the toner cartridge 42 was inserted, or that toner quantity is not monotonically decreasing. For example, if the processed signal from the receive electrode 48 indicates low toner quantity, but processed signals from electrodes 46 and 47 indicate somewhat higher toner quantities, a warning may be issued by processing block 100 that the cartridge 42 needs to be removed and shaken to redistributed toner.

Other features, such as ignoring the toner quantity readings or expecting cartridge replacement when it is detected that the printer lid is open, may also be performed by processing block 100. The output of processing block 100 may also set condition flags available to the printer's processor to warn that the toner measurement may be temporarily unreliable, and prediction of toner quantity should be temporarily based on page count, print density, and other conventional measures.

Measurements from receive electrodes 46–48 may be disabled in some embodiments of this invention after components in the toner cartridge 42 are electrically energized, as this can cause high levels of electrical noise making computation of toner quantity unreliable.

Figure 14:
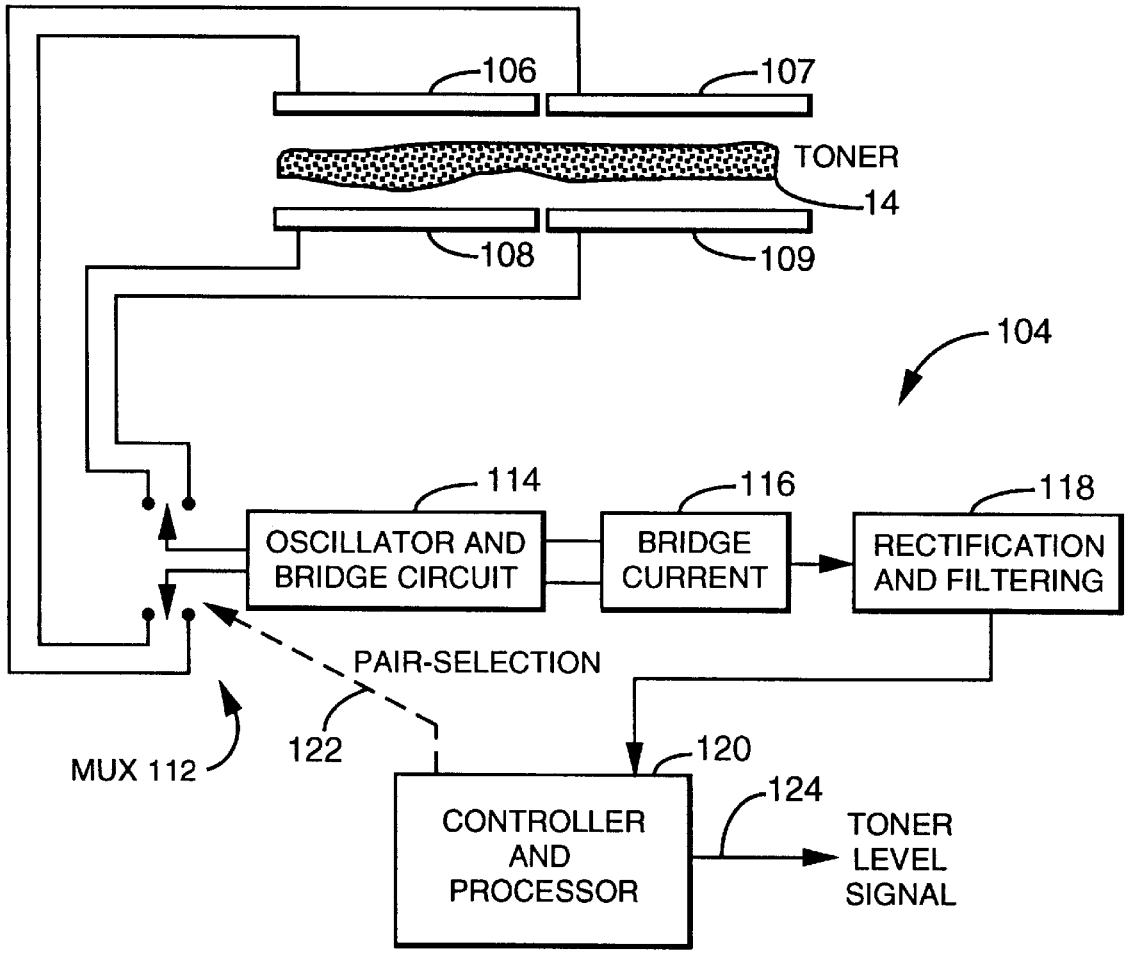
FIG. 14 is a functional block diagram of an alternative embodiment of the invention.

FIG. 14 illustrates another possible block diagram of a measuring circuit 104 for measuring the different capacitances between pair-wise combinations of multiple upper and lower electrodes and for converting these measurements to a toner-quantity signal. Although the circuit illustrates upper-lower pairing of capacitance electrode, it could be easily be extended to include measurements of capacitances between separate upper electrodes or between separate lower electrodes as well.

The capacitance electrodes 106–109 are selected pair-wise by a selector or multiplexer 112 and thereby connected into a conventional bridge circuit 114 driven by an oscillating voltage source. Any imbalance in impedance between one side of the bridge containing known reference impedances and the other side of the bridge containing the selected electrode-pair causes a differential bridge current 116 that is measured by a conversion circuit (rectification and filtering 118) and then output to a controller and processor 120. The controller and processor 120 can control, using signal 122, the electrode multiplexer 112 to accomplish capacitance measurements over the combination of useful electrode pairs. These measurements may then be processed to produce an output toner-quantity signal 124.

A simple algorithm for combining the various capacitance measurements involves adding the measured values together. More complicated transformations can be developed for any specific toner cartridge to incorporate weighting factors on individual measurements providing the most accurate reading of toner quantity.

The circuits described above are only a few of the possible implementations, and those skilled in the art of capacitance measurement and quantity sensing can easily apply other measurement techniques. Two other examples include automatic selection of reference impedances to maintain the bridge current near a null value, or by measuring electrode-electrode capacitances directly, such as placing the capacitance to be determined within a voltage divider or oscillator circuit.

Figure 13:
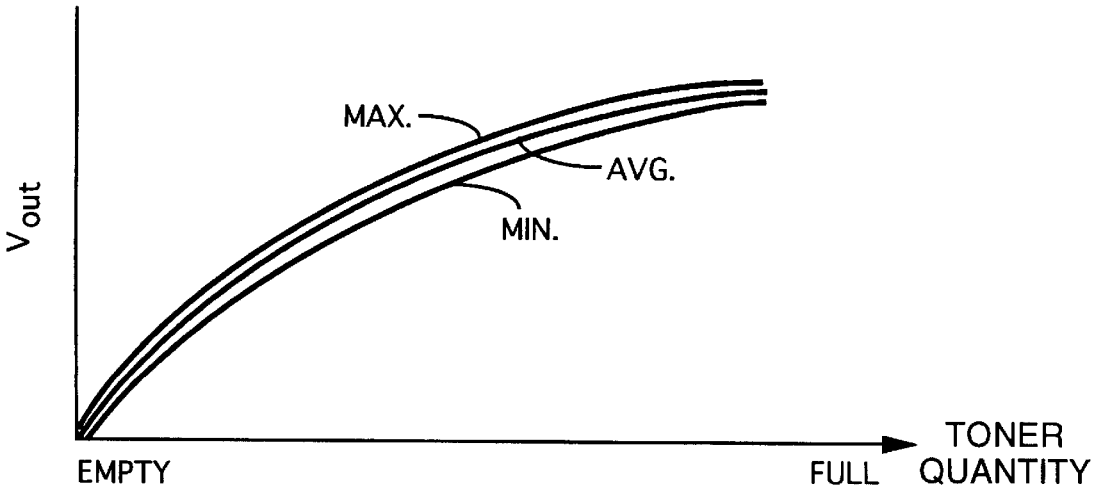
FIG. 13 is a graph of the received signal vs. toner quantity.

In one embodiment, the modulation of the received signal in FIGS. 12 and 13 can be used to identify the dielectric coefficient of the toner by measuring the difference between the minimum and maximum values. Such a correspondence between the minimum and maximum values and the dielectric coefficient would be obtained empirically. Process 96 in FIG. 9 would verify the dielectric coefficient for validating accuracy of toner quantity measurements.

The basic principle of the present invention has been described for a dielectric, dry toner in an electrophotographic printer. The scope of the current invention is not restricted to toner quantity measurement in dry electrophotography. Those skilled in the art can apply the principles described herein to measure toner quantity in liquid electrophotographic printers and to measure the quantity of liquid ink in the ink cartridges of ink jet printers.

Since it is desired to maximize induced charge movement to/from the receive electrode(s), guard voltage electrode(s) may be incorporated to shield other grounded surfaces within the toner cartridge compartment. This can help reduce fringe fields. The use and implementation of guard electrodes is known in the art and will not be discussed further here.

Advantages of the described toner measuring techniques include:

- has no impact on the manufacturing cost of the toner cartridge;
- requires no modifications to the toner cartridge in order to accomplish quantity measurement;
- requires no physical contact with the toner;
- operates in proximity to the toner cartridge without electrical contact;
- provides proportional sensing of toner quantity within a sealed cartridge to a precision better than can be achieved by current methods;
- provides sensing of the distribution of toner within a sealed cartridge;
- operates with magnetic and nonmagnetic toners (single & dual component toners);
- operates with all colors of toner (e.g., black, cyan, magenta, yellow) for use in monochrome and color laser printers and copiers;
- Operates with dry powder and liquid toners including those for electrophotographic and ink jet printers;
- provides inexpensive sensor/detector hardware incorporated into the print engine;
- operates so that toner quantity measurement does not affect throughput of the printer;
- operates so that measurement of toner quantity can be made while the printer is printing pages;
- provides an indication of the quantity and distribution of toner within a toner cartridge that may be used by the printer's processor to terminate or suspend a print job when the toner quantity or distribution may affect the quality of the printed output;
- allows the user to monitor the quantity of toner remaining to allow the user to replace the cartridge at the most appropriate time;
- provides an indication to the user that the toner cartridge should be removed from the printer/copier and manipulated in such a manner that toner is redistributed properly within the cartridge.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter having an input to which is applied a signal corresponding to said displacement current and having an output conveying an indication of toner quantity in said toner container, said indication identifying toner quantities at various levels between full and empty.

2. The apparatus of claim 1 wherein said toner container and receptacle are used in an electrophotographic printer.

3. The apparatus of claim 1 wherein said toner container receptacle is used in an electrophotographic copier.

4. The apparatus of claim 1 wherein said detecting circuit is connected to said at least one receive electrode and detects a current in response to a signal applied to said at least one transmit electrode by said signal generator.

5. The apparatus of claim 1 including said toner container.

6. The apparatus of claim 1 wherein said displacement current detecting circuit is a current-to-voltage converter.

7. The apparatus of claim 1 wherein said signal generator is an oscillator.

8. The apparatus of claim 1 wherein said receptacle is located in a laser printer.

9. The apparatus of claim 1 wherein said toner container provides toner for a laser printer.

10. The apparatus of claim 1 wherein said toner container and receptacle are used in an inkjet printer.

11. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container wherein said at least one receive electrode comprises a plurality of receive electrodes, currents through said receive electrodes being selectively sensed to determine a distribution of toner in said toner container.

12. The apparatus of claim 11 herein said plurality of receive electrodes comprises at least two receive electrodes.

13. An apparatus comprising:

a toner container;

a receptacle for said toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container, wherein said toner container contains a mixer that may rotate when said toner container is within said receptacle, said mixer causing said signal corresponding to said displacement current to be modulated at a rotational frequency of said mixer.

14. The apparatus of claim 13 wherein modulation of said signal due to said rotation of said mixer causes said signal corresponding to said displacement current to have a minimum value and a maximum value.

15. The apparatus of claim 14 wherein a difference in said minimum value and said maximum value is processed by said converter to determine a dielectric coefficient of said toner in said toner container.

16. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container, wherein said converter includes a look-up table.

17. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container, wherein said converter includes an analytical expression.

18. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container, wherein said converter includes a fault detector for receiving said signal corresponding to said displacement current and for receiving other signals and for determining whether said signal corresponding to said displacement current is consistent with said other signals to identify whether an anomalous situation has occurred.

19. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container, wherein said signal generator is a digital pulse generator.

20. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner container, wherein said at least one receive electrode comprises a plurality of receive electrodes, said apparatus further comprising:

a multiplexer having inputs connected to each of said receive electrodes; and a multiplexer controller that selects one of said inputs, individually or in combination, for further processing.

21. An apparatus comprising:

a receptacle for a toner container;

at least one transmit electrode;

at least one receive electrode;

said at least one transmit electrode and said at least one receive electrode being located within or about said receptacle such that toner within said toner container, when said toner container is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode;

a converter for converting a signal corresponding to said displacement current to an indication of toner quantity in said toner container; and a ground plane at least partially surrounding said receptacle, said apparatus further comprising a guard electrode located between said at least one transmit electrode and said ground plane, a signal by said generator being connected to said guard electrode.

22. An apparatus comprising:

at least one transmit electrode;

at least one receive electrode;

said at least one transmit electrode and said at least one receive electrode being located within or proximate toner such that said toner is in the vicinity of said at least one transmit electrode and said at least one receive electrode;

a signal generator electrically connected to said at least one transmit electrode;

a detecting circuit electrically connected to detect a displacement current induced by said at least one transmit electrode and to said at least one receive electrode; and a converter having an input to which is applied a signal corresponding to said displacement current and having an output conveying an indication of toner quantity, said indication identifying toner quantities at various levels between full and empty.

23. An apparatus comprising:

at least one transmit electrode;

at least one receive electrode; and said at least one transmit electrode and said at least one receive electrode being located within or proximate toner such that said toner is in the vicinity of said at least one transmit electrode and said at least one receive electrode, such that if a signal generator is electrically connected to said transmit electrode, and if a detecting circuit is electrically connected to detect a displacement current induced by said at least one transmit electrode and to said at least one receive electrode, then a converter can convert a signal corresponding to said displacement current to an indication of toner quantity, said indication identifying toner quantities at various levels between full and empty.

24. An apparatus comprising:

a signal generator able to be electrically connected to at least one transmit electrode;

a detecting circuit able to be electrically connected to detect a displacement current induced by said at least one transmit electrode and to at least one receive electrode; and a converter, such that if said at least one transmit electrode and said at least one receive electrode are located within or proximate toner such that said toner is in the vicinity of said at least one transmit electrode and said at least one receive electrode, said converter is able to convert a signal corresponding to said displacement current to an indication of toner quantity, said indication identifying toner quantities at various levels between full and empty.

25. An apparatus comprising:

a toner cartridge containing toner and a developer roller;

a receptacle for said toner cartridge;

at least one transmit electrode;

at least one receive electrode;

said at least one transmit electrode and said at least one receive electrode being located within or about said receptacle such that toner within said toner cartridge, when said toner cartridge is placed in said receptacle, is in the vicinity of said at least one transmit electrode and said at least one receive electrode;

a signal generator electrically connected to said transmit electrode;

a detecting circuit electrically connected to detect a displacement current induced by at least one transmit electrode and to said at least one receive electrode; and a converter for converting a signal corresponding to said displacement current to an indication of toner quantity in said toner cartridge.

26. A method performed by a printer, said printer having a receptacle into which is placed a toner container, said method comprising:

applying a signal between at least one transmit electrode and at least one receive electrode, at least a portion of said toner container being near said at least one transmit electrode and said at least one receive electrode;

detecting a displacement current induced by said at least one transmit electrode into said at least one receive electrode with toner within said toner container forming a portion of a dielectric within the electric field established by said at least one transmit electrode and said at least one receive electrode; and converting a signal corresponding to said displacement current into an indication of toner quantity in said toner container, said indication indicating toner quantities of various levels between full and empty.

27. A method performed by a printer, said printer having a receptacle into which is placed a toner container, said method comprising:

applying a signal between at least one transmit electrode and at least one receive electrode, at least a portion of said toner container being near said at least one transmit electrode and said at least one receive electrode;

detecting a displacement current induced by said at least one transmit electrode into said at least one receive electrode with toner within said toner container forming a portion of a dielectric within the electric field established by said at least one transmit electrode and said at least one receive electrode; and converting a signal corresponding to said displacement current into an indication of toner quantity in said toner container, wherein said step of converting comprises processing said displacement current into a form which generates an address to a look-up table correlating a toner quantity to a particular displacement current.

28. A method performed by a printer, said printer having a receptacle into which is placed a toner container, said method comprising:

applying a signal between at least one transmit electrode and at least one receive electrode, at least a portion of said toner container being near said at least one transmit electrode and said at least one receive electrode;

detecting a displacement current induced by said at least one transmit electrode into said at least one receive electrode with toner within said toner container forming a portion of a dielectric within the electric field established by said at least one transmit electrode and said at least one receive electrode; and converting a signal corresponding to said displacement current into an indication of toner quantity in said toner container, wherein said step of converting comprises processing said displacement current into a form which generates an independent variable in an analytical expression to correlate toner quantity to a particular displacement current.

29. A method performed by a printer, said printer having a receptacle into which is placed a toner container, said method comprising:

applying a signal between at least one transmit electrode and at least one receive electrode, at least a portion of said toner container being near said at least one transmit electrode and said at least one receive electrode;

detecting a displacement current induced by said at least one transmit electrode into said at least one receive electrode with toner within said toner container forming a portion of a dielectric within the electric field established by said at least one transmit electrode and said at least one receive electrode;

converting a signal corresponding to said displacement current into an indication of toner quantity in said toner container; and compensating for toner flocculation and its effects on dielectric constant and the surface height of toner.

30. A method performed by a printer, said printer having a receptacle into which is placed a toner cartridge having a developer roller, said method comprising:

applying a signal between at least one transmit electrode and at least one receive electrode, at least a portion of said toner cartridge with said developer roller being near said at least one transmit electrode and said at least one receive electrode, detecting a displacement current induced by said at least one transmit electrode into said at least one receive electrode with toner within said toner cartridge forming a portion of a dielectric within the electric field established by said at least one transmit electrode and said at least one receive electrode; and converting a signal corresponding to said displacement current into an indication of toner quantity in said toner cartridge.

* * * * *